US007954727B2

(12) United States Patent
Cox et al.

(10) Patent No.: US 7,954,727 B2
(45) Date of Patent: Jun. 7, 2011

(54) ANCHORING DEVICES FOR RAIL FASTENING CLIPS

(75) Inventors: Stephen John Cox, Richmond (GB); John Phillip Porrill, Godalming (GB); Robert John Hamilton, Woking (GB); Jozef Nevidal, Kellyville (GB); Martin Somerset, Worksop (GB); Paul Hewlett, Langold (GB); Christopher Gardner, Worksop (GB)

(73) Assignee: Pandrol Limited, Addlestone, Surrey (GB)

( * ) Notice: Subject to any disclaimer, the term of this patent is extended or adjusted under 35 U.S.C. 154(b) by 59 days.

(21) Appl. No.: 12/279,170

(22) PCT Filed: Feb. 21, 2007

(86) PCT No.: PCT/GB2007/000602

§ 371 (c)(1), (2), (4) Date: Nov. 17, 2008

(87) PCT Pub. No.: WO2007/096613

PCT Pub. Date: Aug. 30, 2007

(65) Prior Publication Data

US 2009/0218410 A1 Sep. 3, 2009

(30) Foreign Application Priority Data

Feb. 21, 2006 (GB) ..... 0603434.2

(51) Int. Cl.
*E01B 9/00* (2006.01)

(52) U.S. Cl. ..... 238/343; 238/349; 238/351

(58) Field of Classification Search ..... 238/349, 238/351–354, 315, 343, 344, 345
See application file for complete search history.

(56) References Cited

U.S. PATENT DOCUMENTS 3,471,118 A * 10/1969 Von Schell et al. ..... 249/91

(Continued)

FOREIGN PATENT DOCUMENTS

DE 658902 4/1938

(Continued)

OTHER PUBLICATIONS

International Search Report and Written Opinion of The International Searching Authority, corresponding to International application No. PCT/GB07/000606.

(Continued)

*Primary Examiner* — S. Joseph Morano
*Assistant Examiner* — Jason C Smith
(74) *Attorney, Agent, or Firm* — Husch Blackwell

(57) ABSTRACT

A shoulder for use in retaining a railway rail fastening clip, comprising two interconnected spaced-apart walls, between which a portion of the clip to be retained is held when the shoulder is in use, and clip-engaging means, supported by the walls, for engaging a portion of the clip to be retained, does not have any feature or surface which engages the surface of that clip portion which faces downwardly when the clip is in use. Alternatively, or in addition, none of the contact regions, at which the device engages the rail clip, can be seen when the anchoring device is viewed from above when in its operative orientation and all of the contact regions can be seen when the anchoring device is viewed from below when in the operative orientation. Alternatively, or in addition, all the contact regions lie substantially at the same horizontal distance from the edge of the rail foot when measured perpendicularly to the axis of the rail and in the plane of the rail foot.

21 Claims, 15 Drawing Sheets

U.S. PATENT DOCUMENTS

| | | | | | |
|---|---|---|---|---|---|
| 3,581,990 | A * | 6/1971 | Kirik | 238/283 |
| 3,876,141 | A * | 4/1975 | French | 238/349 |
| 4,061,270 | A * | 12/1977 | Wandrisco | 238/107 |
| 4,239,156 | A * | 12/1980 | Skinner et al. | 238/277 |
| 4,632,307 | A * | 12/1986 | Weber | 238/265 |
| 4,907,740 | A * | 3/1990 | Oberweiler et al. | 238/283 |
| 5,474,233 | A * | 12/1995 | Cailliau | 238/351 |
| 5,520,330 | A * | 5/1996 | Brown et al. | 238/351 |
| 5,566,882 | A * | 10/1996 | Brown et al. | 238/343 |
| 5,735,458 | A * | 4/1998 | Brown et al. | 238/343 |
| 6,305,613 | B1 * | 10/2001 | Igwemezie | 238/287 |
| 6,367,704 | B1 * | 4/2002 | Mediavilla | 238/310 |
| 6,702,192 | B2 * | 3/2004 | Igwemezie | 238/338 |
| 6,761,322 | B1 * | 7/2004 | Porrill et al. | 238/264 |
| 7,374,109 | B2 * | 5/2008 | Ellerhorst | 238/283 |
| 7,648,080 | B2 * | 1/2010 | Hohne et al. | 238/351 |
| 7,673,810 | B2 * | 3/2010 | Young | 238/351 |
| 2009/0218410 | A1 * | 9/2009 | Cox et al. | 238/343 |

FOREIGN PATENT DOCUMENTS

| | | |
|---|---|---|
| DE | 2813819 | 10/1979 |
| DE | 8804426 | 6/1988 |
| DE | 3820243 | 2/1990 |
| EP | 826826 | 3/1998 |
| FR | 2450902 | 10/1980 |
| GB | 2106570 | 4/1983 |
| GB | 2117035 | 10/1983 |
| GB | 2235003 | 2/1991 |
| GB | 2239035 | 6/1991 |
| GB | 2261241 | 5/1993 |
| GB | 2351515 | 1/2001 |
| GB | 2358423 | 7/2001 |
| JP | 2002121701 | 4/2002 |
| WO | WO 93/12294 | 6/1993 |
| WO | WO 93/12295 | 6/1993 |
| WO | WO 93/12296 | 6/1993 |
| WO | WO 03/101693 | 12/2003 |
| WO | WO 2005/106124 | 11/2005 |

OTHER PUBLICATIONS

UK Patent Search Report of the UK Patent Office, corresponding to UK application No. 0603434.2.

EPO Standard Search Report issued on priority UK application No. 0603434.2, dated Sep. 8, 2006.

EPO Standard Search Report issued on priority UK application No. 0603434.2, dated Sep. 12, 2006.

* cited by examiner

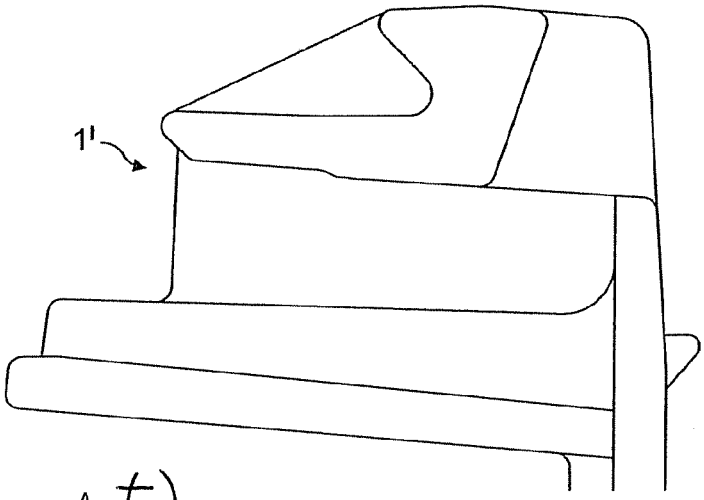
(Prior Art) FIG. 1A
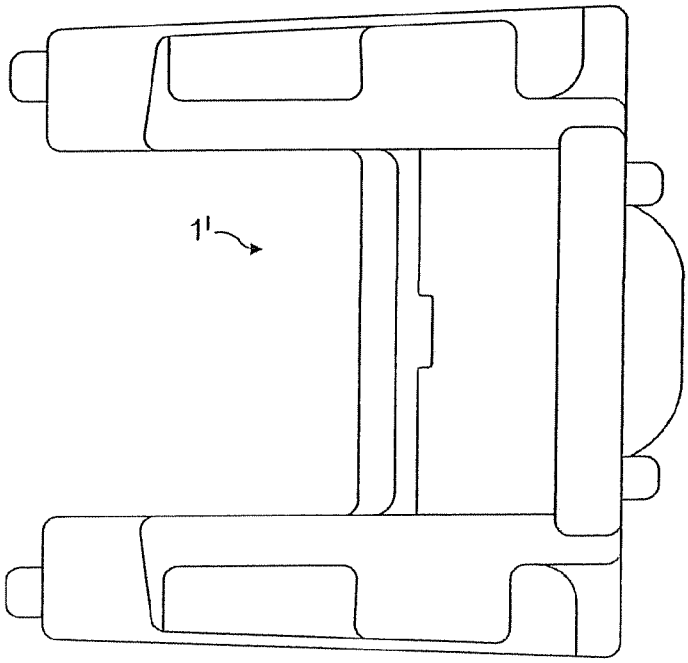
(Prior Art) FIG. 1B

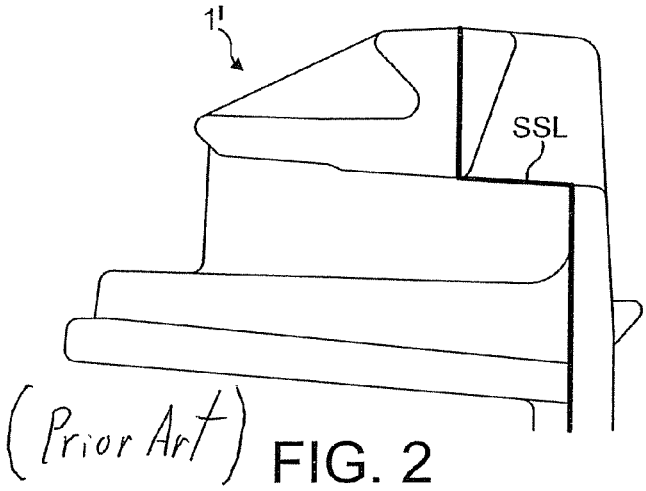
(Prior Art) FIG. 2
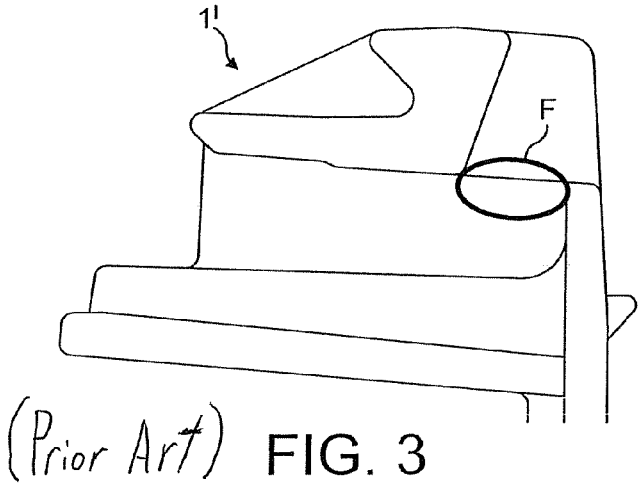
(Prior Art) FIG. 3
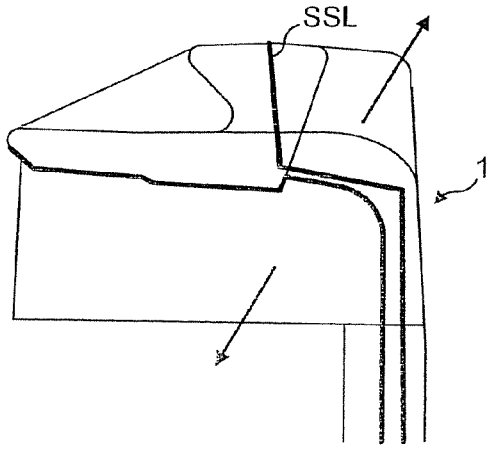
FIG. 4

ANCHORING DEVICES FOR RAIL FASTENING CLIPS

The present invention relates to anchoring devices for rail fastening clips.

In the documents WO93/12294, WO93/12295 and WO93/12296, the present applicants disclosed a railway rail fastening system in which a rail fastening clip is driven laterally onto the rail and can be held in a clip anchoring device (shoulder) in a "pre-assembly" or "parked" position in which the toe portion of the clip does not bear on the rail. This enables railway sleepers to be preloaded at the factory with clips which are held in the pre-assembly position such that when the sleepers are delivered to site the clips can simply be driven home once the rail is in place. In addition, when maintenance of the rail or sidepost insulators (which lie between the rail and the shoulder) is subsequently required, the clip can be driven off the rail back into the pre-assembly position, or further into an "insulator-change position" in which the clip does not overlie the sidepost insulator, so complete withdrawal of the clip from the shoulder is not necessary. Such clips are sometimes known as "switch-on/switch-off" clips. Such a fastening system has proved to be very successful, but the applicant is desirous of making improvements to some aspects of its manufacture and use.

Shoulders 1' for retaining switch-on/switch-off clips, such as shown in FIGS. 1A and 1B of the accompanying drawings, are made by casting. Features on the casting cooperate with mating features on the clip to retain the clip positively at each of the positions described above. The process by which cast iron shoulders are manufactured is usually highly automated, but is really just a mechanized version of the following simple manual process. A pattern is first manufactured, which is basically a re-useable model of the finished part. The pattern is pressed into a box that is made up of two halves, each of which is filled to the brim with moulding sand. The two halves are separated and the pattern is removed, so that a mirror image impression is left in the sand, half of which is in one box and the other in the other box. In order to be able to pull the pattern out of the sand without the walls of the void caving in, the pattern has to taper away in all directions from the joint line between the two halves of the box. The two halves of the box are then joined back together, and molten cast iron is poured into the void. When it has set, the box is split again, and the finished part is removed. The sand is then taken out of the box, cleaned, and repacked in for the next moulding cycle. On the finished part, you are typically left with a flash line around the joint (the split line) between the two halves of the box, and a sprue where the molten metal was fed in. If these are in critical areas on the finished part, they have to be dressed off (fettled). In particular, fettling is required if overhangs and the like, which form clip-retention features on the casting, have to be formed on the split line, it not being possible to create overhanging features or voids in the casting without using separate cores (which is undesirable as it adds to the complexity and expense of the process). In some castings, the shape of the part may dictate that, rather than having a simple planar split between the two halves of the box, the joint will need to be stepped. Although quite possible, this more complex joint line is a disadvantage in production.

A shoulder 1' of the kind shown in FIGS. 1A and 1B requires a relatively complex stepped split line, as shown by the line SSL in FIG. 2 of the accompanying drawings. Moreover, as shown by the ringed area F in FIG. 3 of the accompanying drawings, part of this stepped split line is critical to the function of the final part and needs to be fettled, but is not easily accessed and so is difficult to fettle accurately.

According to a first aspect of the present invention there is provided an anchoring device for use in retaining a railway rail fastening clip, the device comprising two interconnected spaced-apart walls, between which a portion of the clip to be retained is held when the anchoring device is in use, and clip-engaging means, supported by the walls, for engaging a portion of the rail fastening clip to be retained, wherein the device does not have any feature or surface which engages the surface of that clip portion which faces downwardly when the clip is in use.

In an anchoring device embodying a second aspect of the present invention, the clip-engaging means define contact regions at which the device engages the rail clip to be retained when the clip bears on a railway rail, the device not engaging the clip at any other region of the device when the clip is bearing on the rail in normal operation, such that none of the said contact regions of the device can be seen when the anchoring device is viewed from above when in its operative orientation in which it will be used when adjacent to a railway rail and all of the said contact regions of the device can be seen when the anchoring device is viewed from below when in the said operative orientation.

In an anchoring device embodying a third aspect of the present invention, when the device is in use, all the said contact regions of the device lie substantially at the same horizontal distance from the edge of the rail foot when measured perpendicularly to the axis of the rail and in the plane of the rail foot.

By removing the clip-engaging features on the lower part of the walls of the shoulder 1, the split line SSL can be moved to an area where minimum fettling is required, whilst allowing the sand to be drawn at an angle sufficient to allow a sharp clip retention feature to be formed, as required for the switch-on/switch off function of the shoulder, as shown by the arrows in FIG. 4 of the accompanying drawings. Moreover, by moving the split line compared to the prior art, the shoulder 1 is strengthened against accidental damage when in track if struck by machinery or hand-held equipment.

Preferably, the walls are interconnected by a connection portion which has a part which extends between the walls from the one end thereof, which will be closest to the railway rail when the device is in use, towards the other end thereof and has a top surface which extends in a downwardly-inclined direction so as to form a ramp for deflecting a portion of the railway rail fastening clip to be retained as it is driven into the anchoring device. The ramp also serves the function of bracing the walls of the anchoring device, making it stronger.

Preferably, the connection portion has another part which extends between the one end of the walls below the top surface to form a bearing face. Desirably, the height of the bearing face is less than that of the said walls, more preferably approximately half that of the walls.

The part of the connection portion forming a ramp may be connected to the walls along its side edges.

An anchoring device embodying the first to third aspects of the present invention may comprise a head provided with the said clip-engaging means and a stem extending downwardly beneath the head of the device, for use in connecting the device to a concrete sleeper. The stem may be located at a first end of the head, which first end is adjacent to a railway rail when the device is in use and is preferably approximately Y-shaped such that the portions of the stem which form the upper ends of the Y are connected to the head of the device. Preferably, the anchoring device further comprises at least one tang which extends downwardly from the underside of the head of the device, which may be located at or near a second end of the head, opposite to the first. Alternatively, or in addition, there is at least one web extending between the stem and the underside of the head.

A Y-shaped stem on the shoulder allows some weight to be saved relative to existing shoulders. It may be applied not only to shoulders embodying the first to third aspects of the present invention, but also to other shoulders.

A sealing plate which extends over the underside of the shoulder can replace the clip engaging features omitted from the shoulder embodying the first to third aspects of the present invention, and, if made of plastics material, also allows weight and cost, to be taken out of the overall assembly. The plate is desirably made, for example, of nylon, glass-reinforced plastic or similar. Such a sealing plate is the subject of the applicant's co-pending PCT application.

Typically, shoulders for retaining switch-on/switch-off clips are secured to concrete railway sleepers (ties) by embedding a stem of the shoulder in the concrete during manufacture of the sleeper. The sleepers are manufactured upside down, so that the top of the finished sleeper is formed by the bottom of the mould pocket. During manufacture, the parts of the shoulder that stick up above the finished sleeper therefore stick down through apertures cut into the floor of the mould pockets at appropriate positions for this purpose. The stems of the shoulders that end up cast into the concrete sleeper stick up into the mould pocket before the concrete is poured. The first step in the manufacturing process is to turn the cast shoulder upside down and push it down from above through an aperture in the mould pocket to refusal. When the concrete has been poured and allowed to set, the sleepers are lifted out of the moulds and turned the right way up. A difficulty with the process is that if the apertures in the bottom of the mould pockets are not a very close fit around the edges of the cast shoulders, concrete will leak through the gap and it may then set on to parts of the shoulder above the finished concrete level and prevent the clip from engaging properly. On the other hand, if the aperture is too small, additional dressing off of the shoulder is required, which is very costly. Given that cast iron shoulders are subject to relatively wide tolerances—typically ±0.8 mm or more—and that the patterns used to produce them wear with time and so the physical size of the part reduces with time, it can be difficult to achieve a good compromise between the necessity of sealing and that of ensuring fit. This is especially the case if the shape of the aperture is relatively complex. Flexible rims fitted to the apertures may be a partial solution, but these wear and require maintenance.

As disclosed in the applicant's co-pending PCT application, in a method of manufacturing a concrete sleeper with at least one embedded rail clip anchoring device of the type having a head for retaining a rail clip and a stem extending from the underside of the head, the floor of a mould, from which the sleeper is to be formed, is provided with an aperture, the head of an anchoring device is inserted through the aperture such that the head of the device extends out of the mould and the stem of the device is located within the mould, and concrete is introduced into the mould, wherein before the concrete is introduced into the mould the aperture is sealed off around its edges and around the underside of the head of the anchoring device by placing a sealing plate over the aperture on the floor of the mould, the plate overlapping and sealing around the edges of the aperture other than where the anchoring device is located and having a mating interface with the anchoring device such that a seal is formed therewith.

Thus, the sealing plate may be used to seal the aperture in the mould pocket and prevent the ingress of concrete into the head of the shoulder. When in use the sealing plate is effectively glued on to the top of the concrete sleeper, such that its top face is flush with the face of the top surface of the concrete on the sleeper top.

Preferably, before the sealing plate is introduced into the mould, it is connected to the anchoring device so as to extend over the underside of the head, the sealing plate being introduced into the mould together with the anchoring device and located over the aperture when the head is inserted through the aperture. Thus, if designed to interlock with the shoulder, the sealing plate can be accurately positioned with ease, and it cannot move up, forward or side-to-side. Nor can it move down or back because it is bonded to the concrete sleeper.

It can easily be made so as to have a simple outline, which need not match the outline of the shoulder, such as rectangular, so the aperture can also have a simple outline. If formed as a plastic moulding, the sealing plate can also have a much tighter tolerance than a cast-iron part, typically ±0.15 mm. However, if the sealing plate is made so as to be significantly larger than the aperture, neither the exact size nor exact shape of the aperture is critical any longer.

When the aperture in the mould is substantially rectangular and a first face of the head of the anchoring device abuts one side of the aperture, the sealing plate is preferably shaped so as to mate with a second face of the head of the anchoring device, opposite to said first face, and to overlap the edges of the aperture on the other three sides thereof. The edge of the sealing plate which mates with the second face of the head may be bevelled so as to match beveling on the said second face.

Reference will now be made, by way of example, to the accompanying drawings in which:

FIGS. 1A and 1B (described above) show respective side and plan views of a prior art anchoring device;

FIG. 2 (described above) shows a side view of FIG. 1A illustrating the position of the stepped split line SSL;

FIG. 3 (described above) shows a side view of FIG. 1A illustrating the location F where fettling is required;

FIG. 4 (described above) shows a side view of an anchoring device embodying the first to third aspects of the present invention on which the position of the stepped split line SSL is illustrated;

Figure 5A:
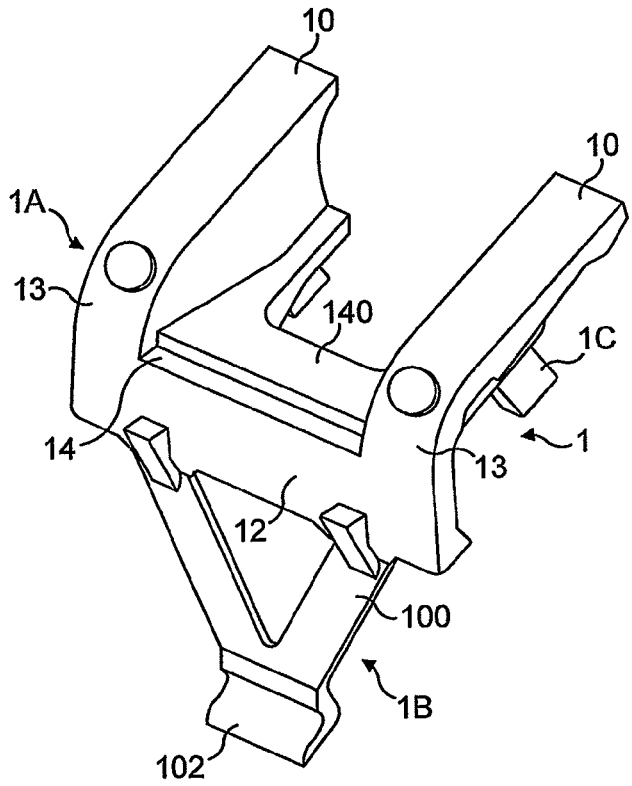
Figure 5B:
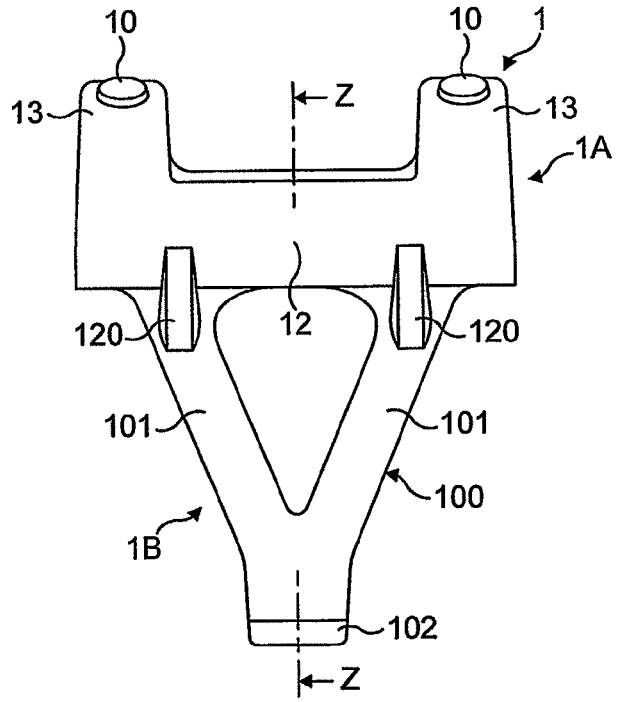
Figure 5C:
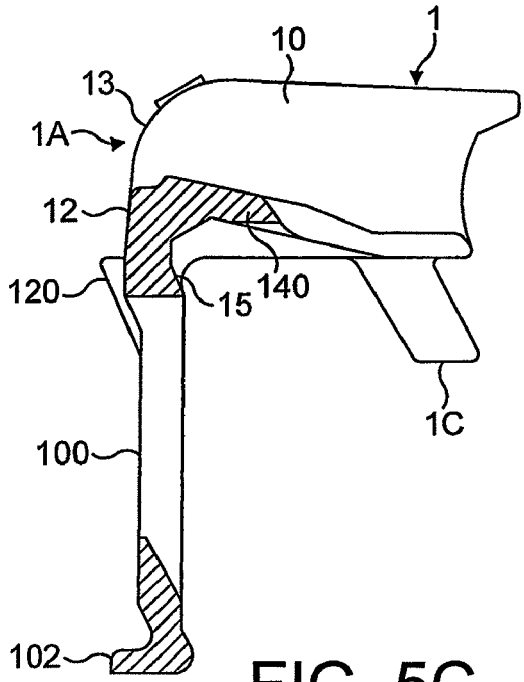
Figure 5D:
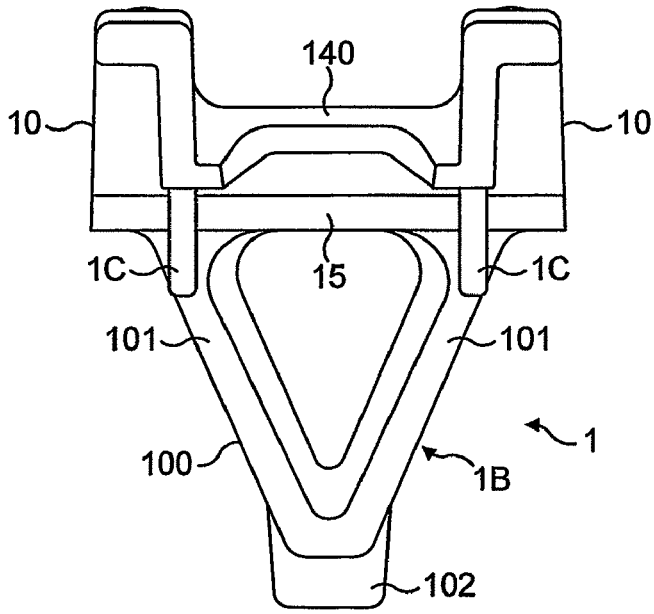
Figure 5E:
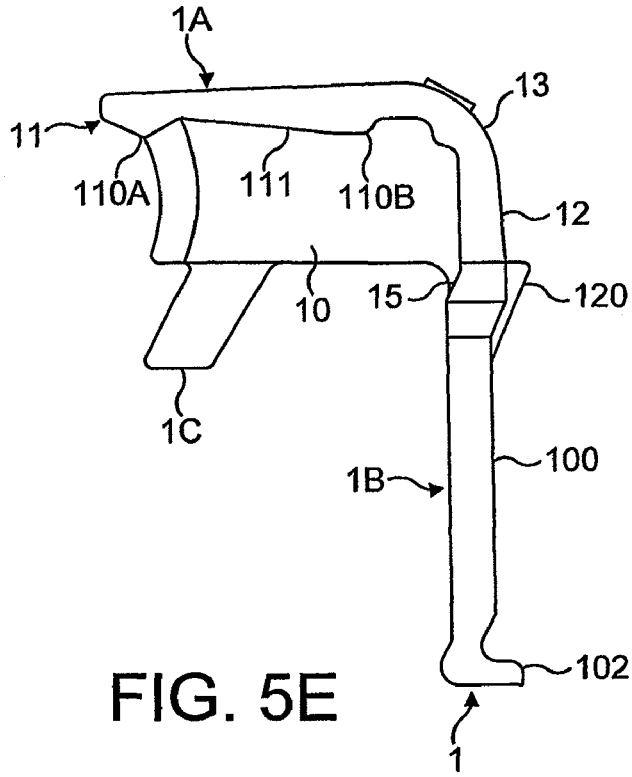
Figure 5F:
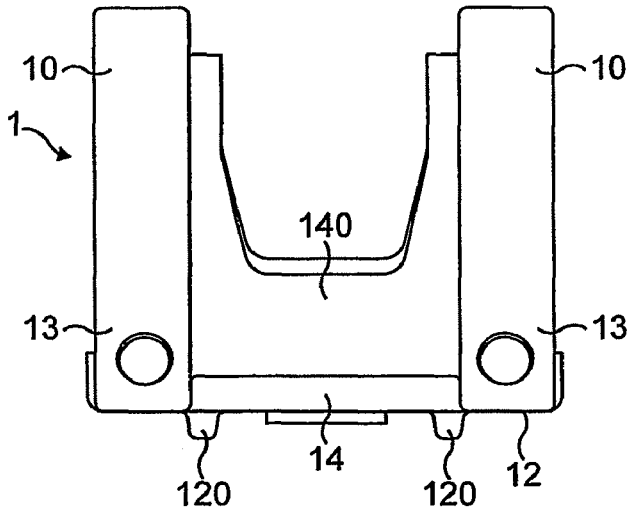
Figure 5G:
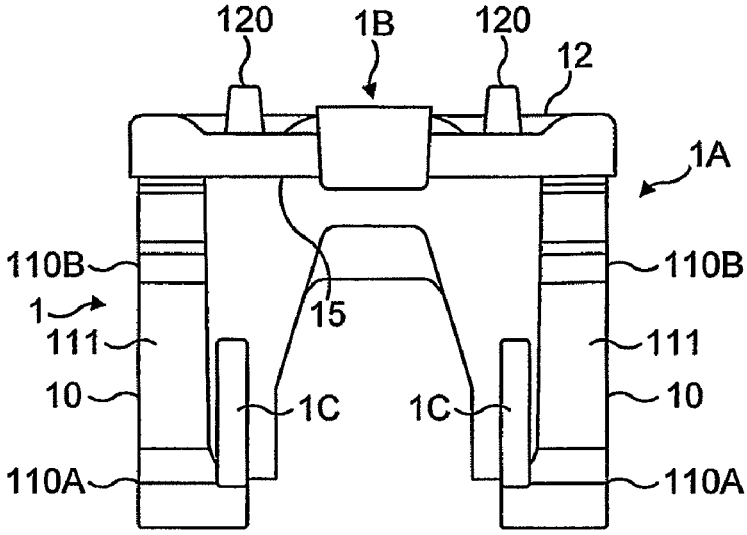
Figure 5H:
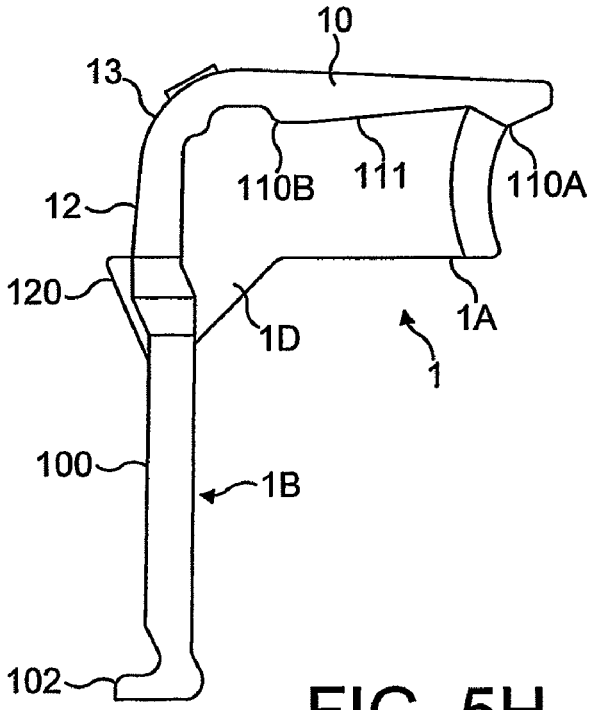
Figure 6A:
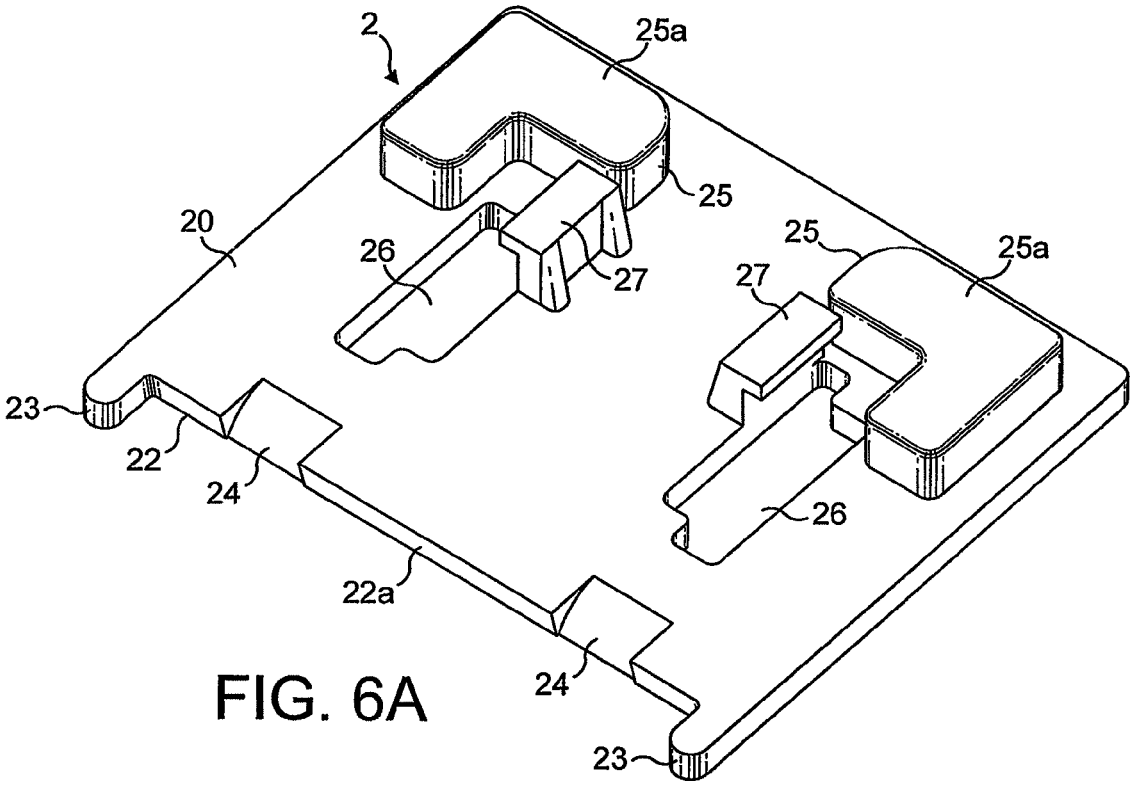
Figure 6B:
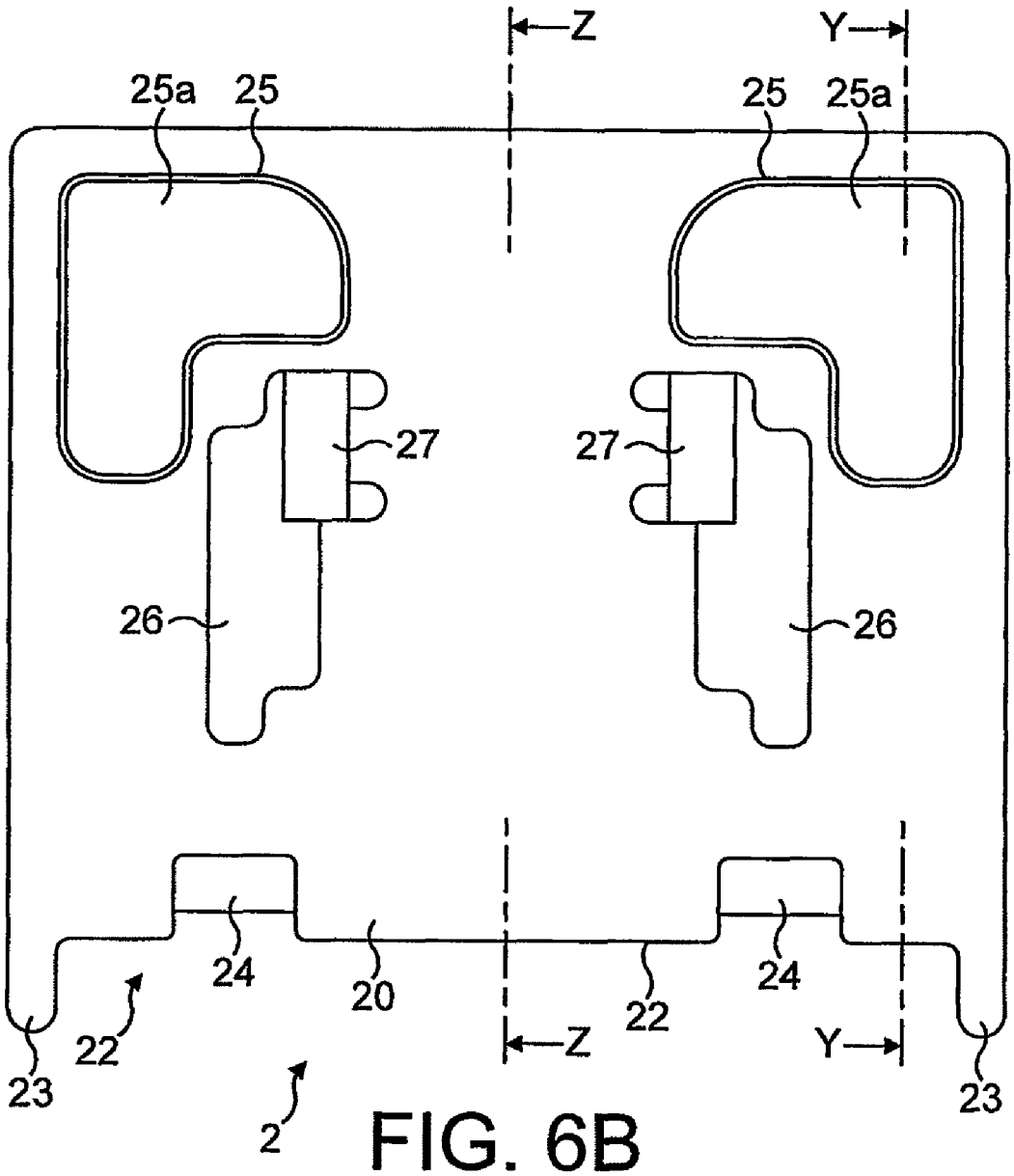
Figure 6C:
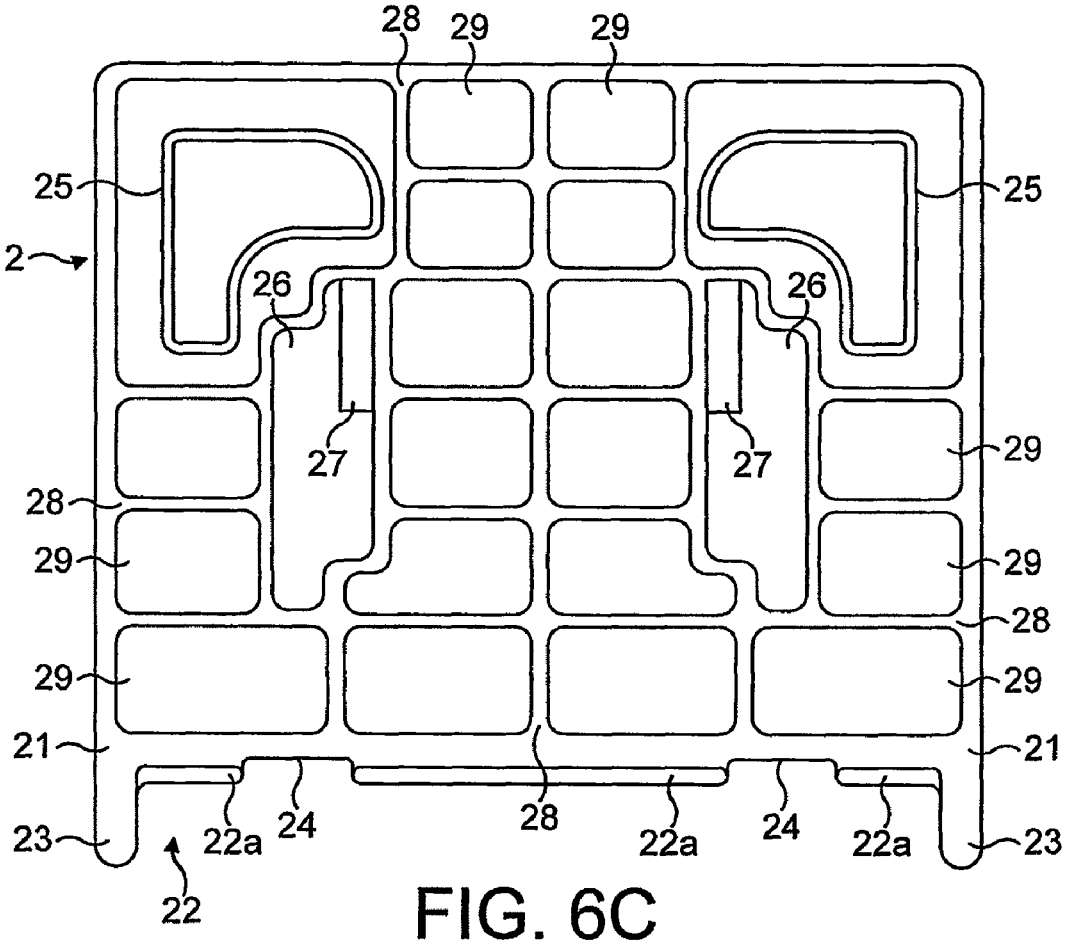
Figure 6D:
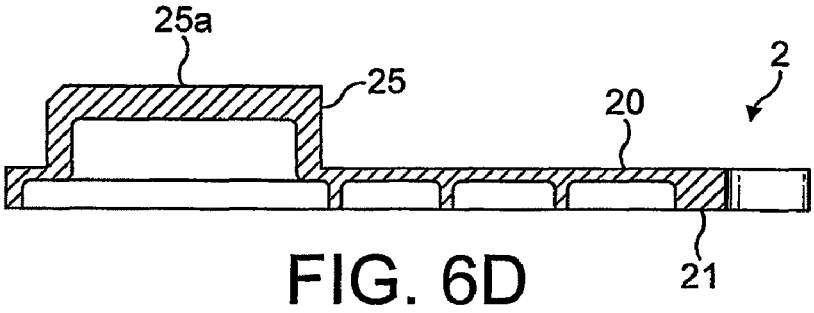
Figure 6E:
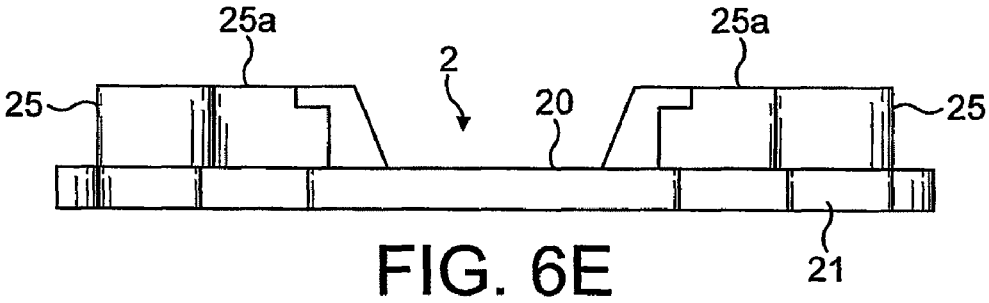
Figure 6F:
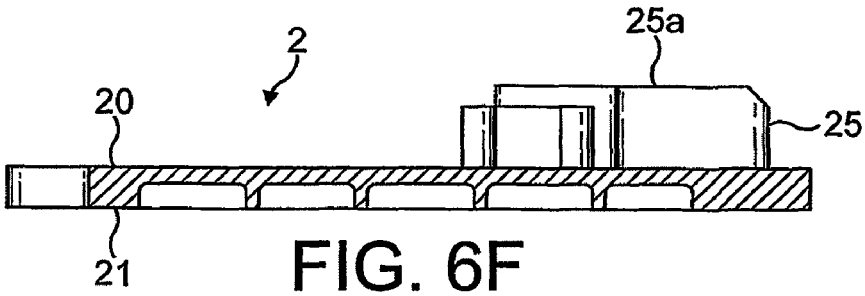
Figure 7A:
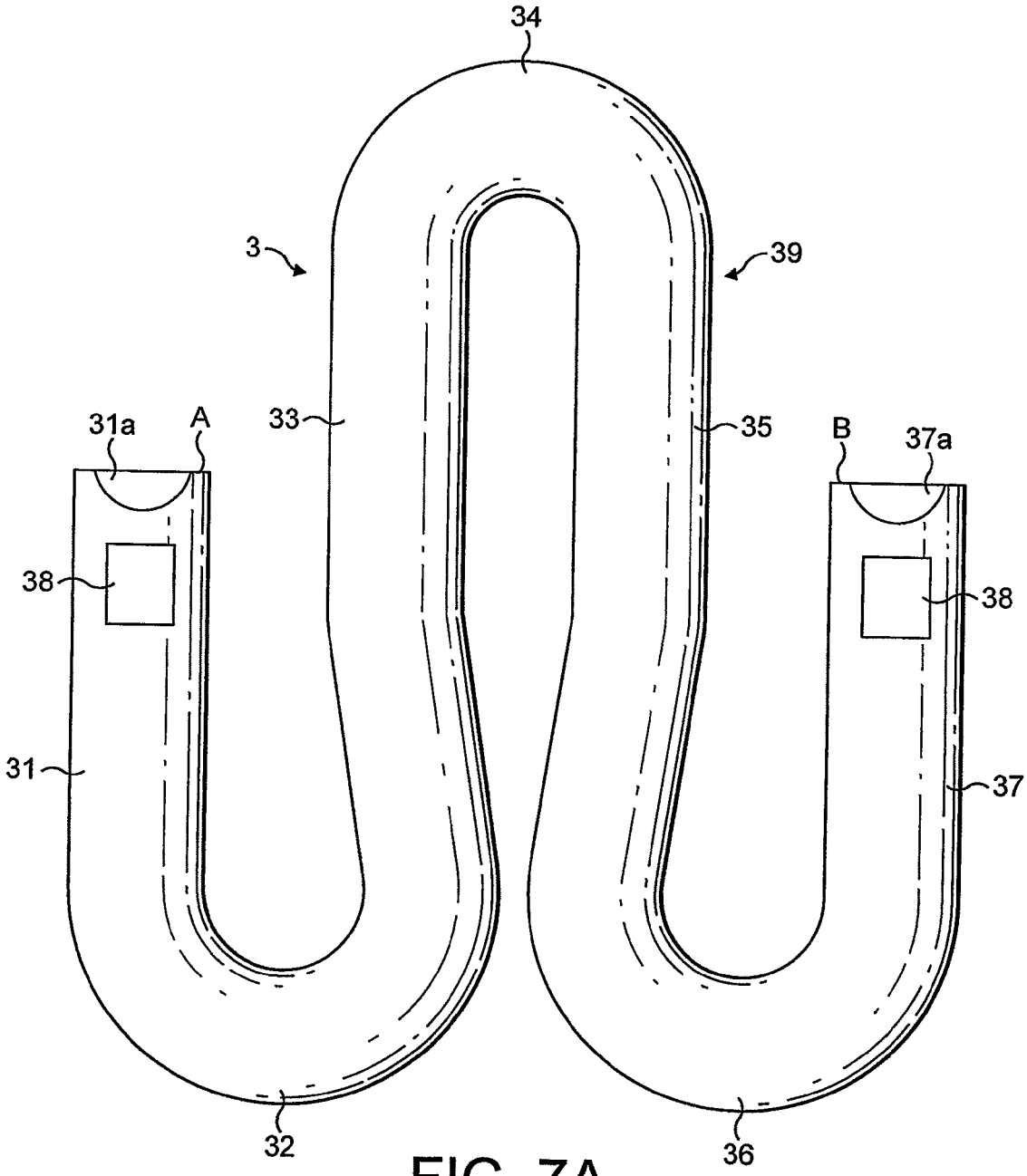
Figure 7B:
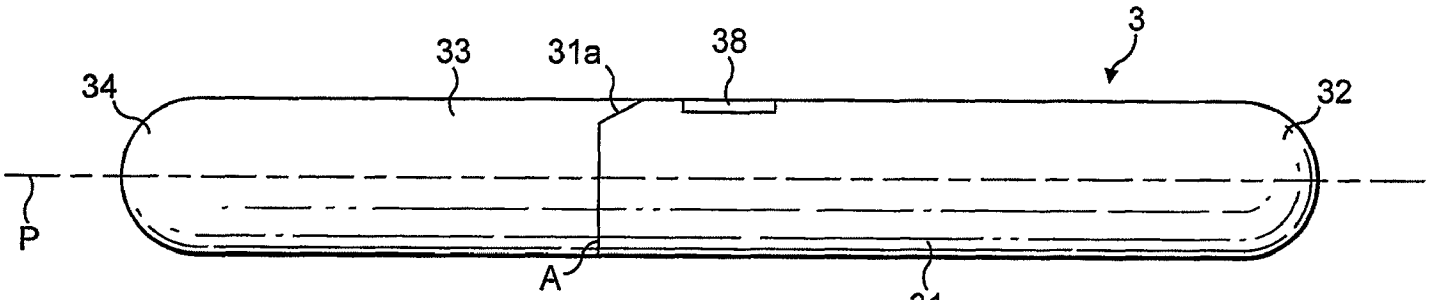
Figure 7C:
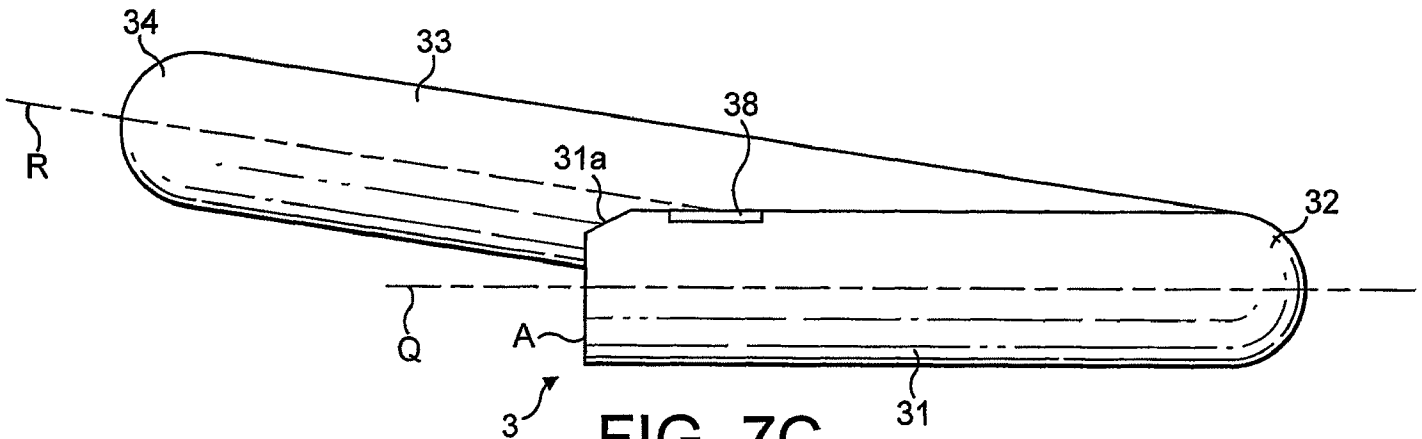
Figure 8A:
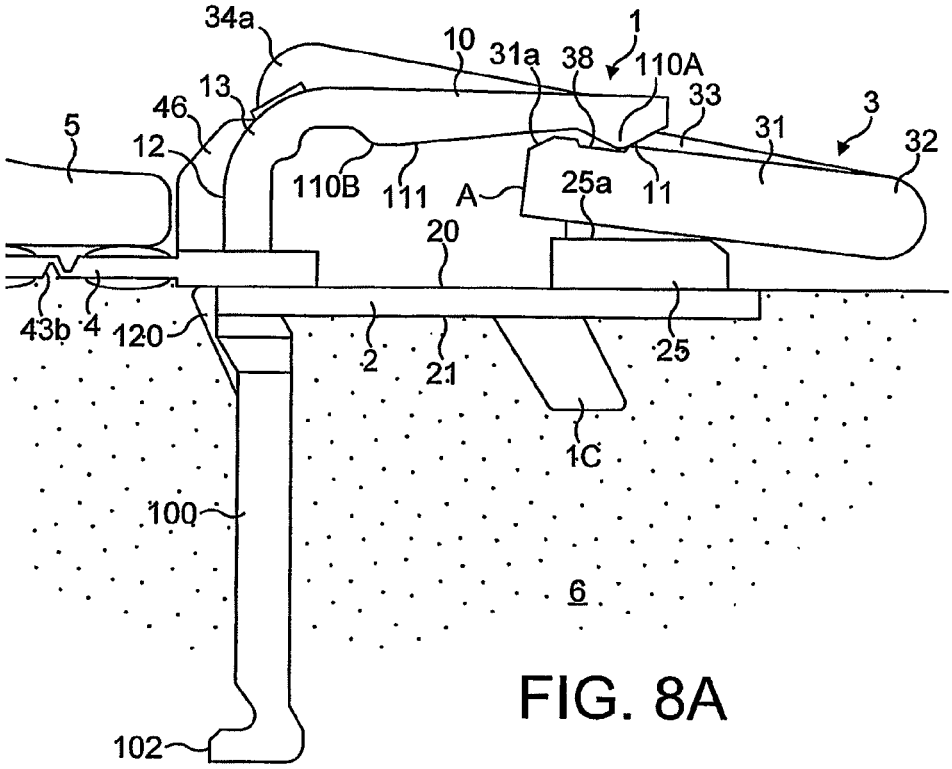
Figure 8B:
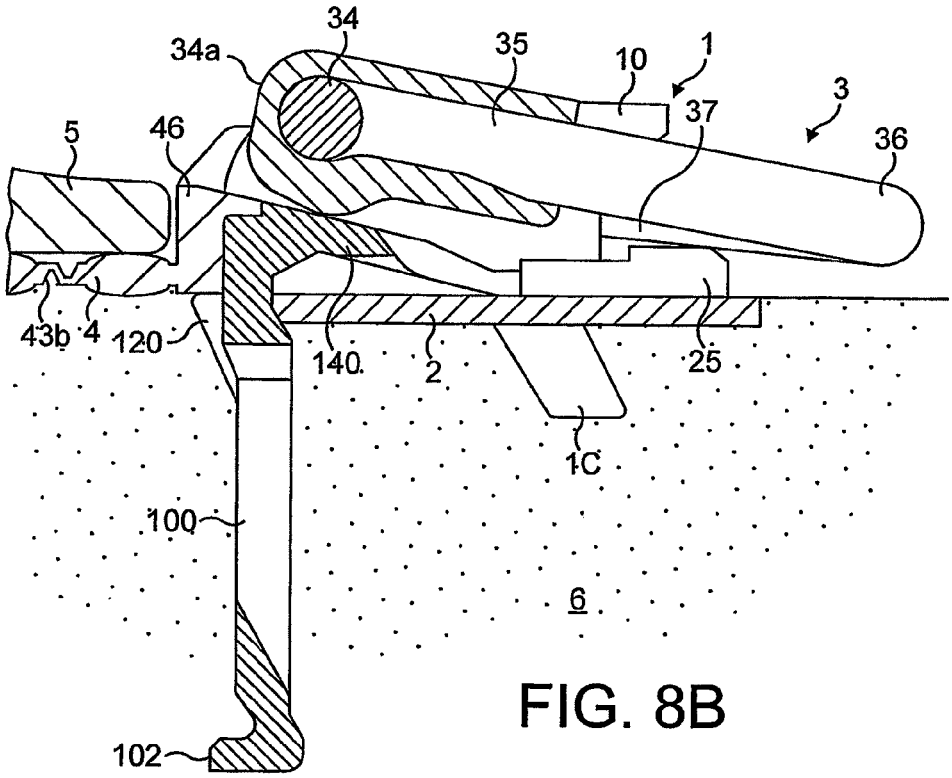
Figure 8C:
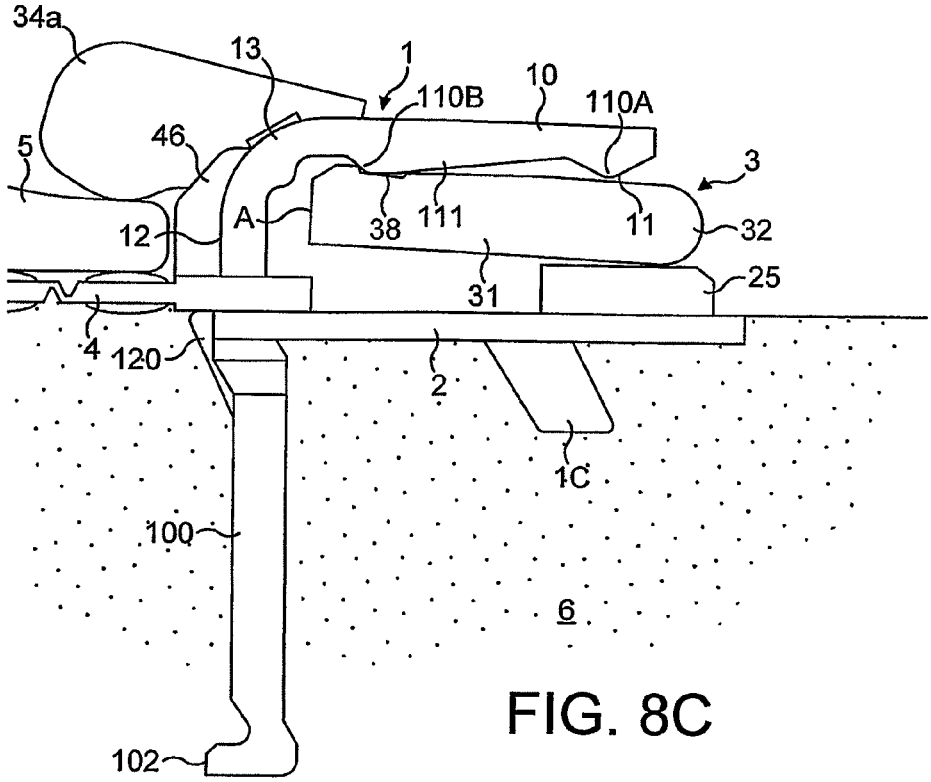
Figure 8D:
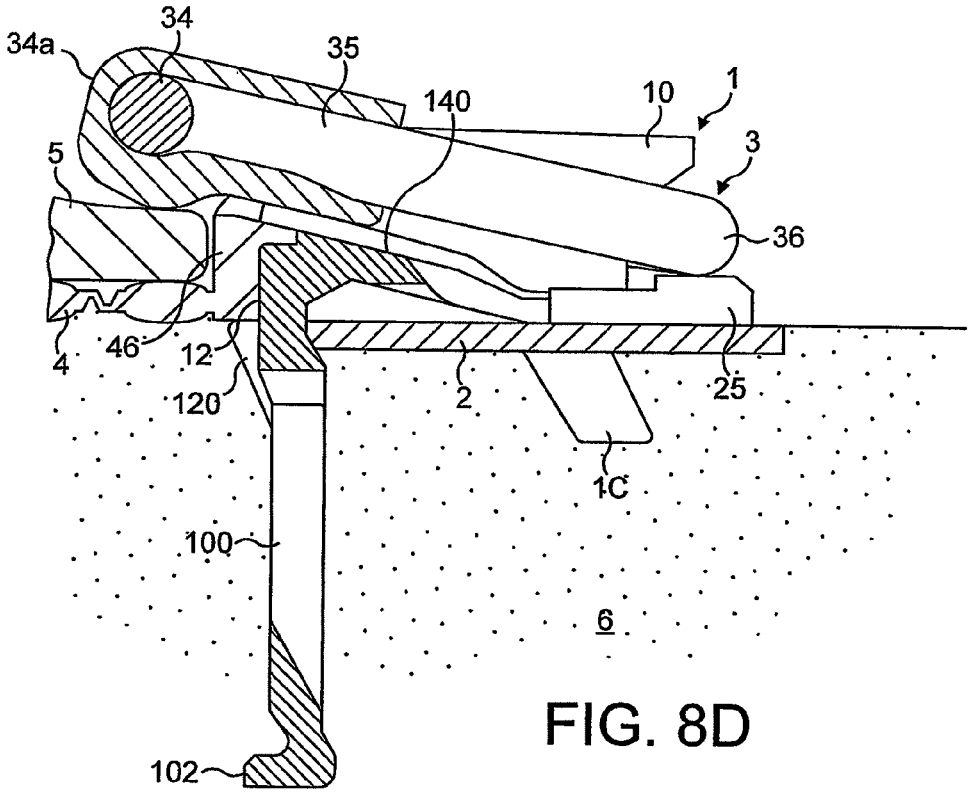
Figure 8E:
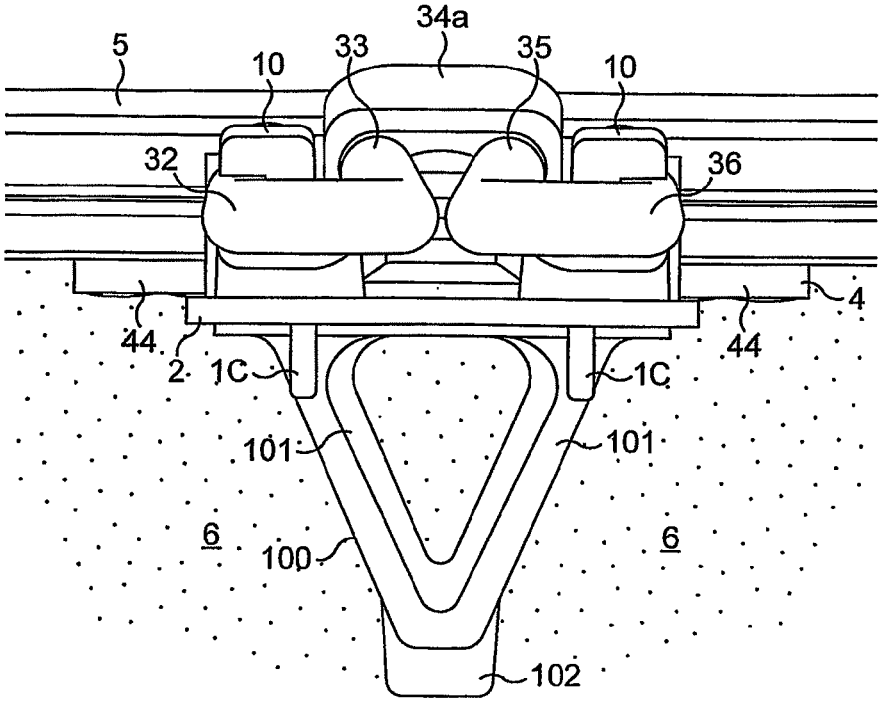
Figure 8F:
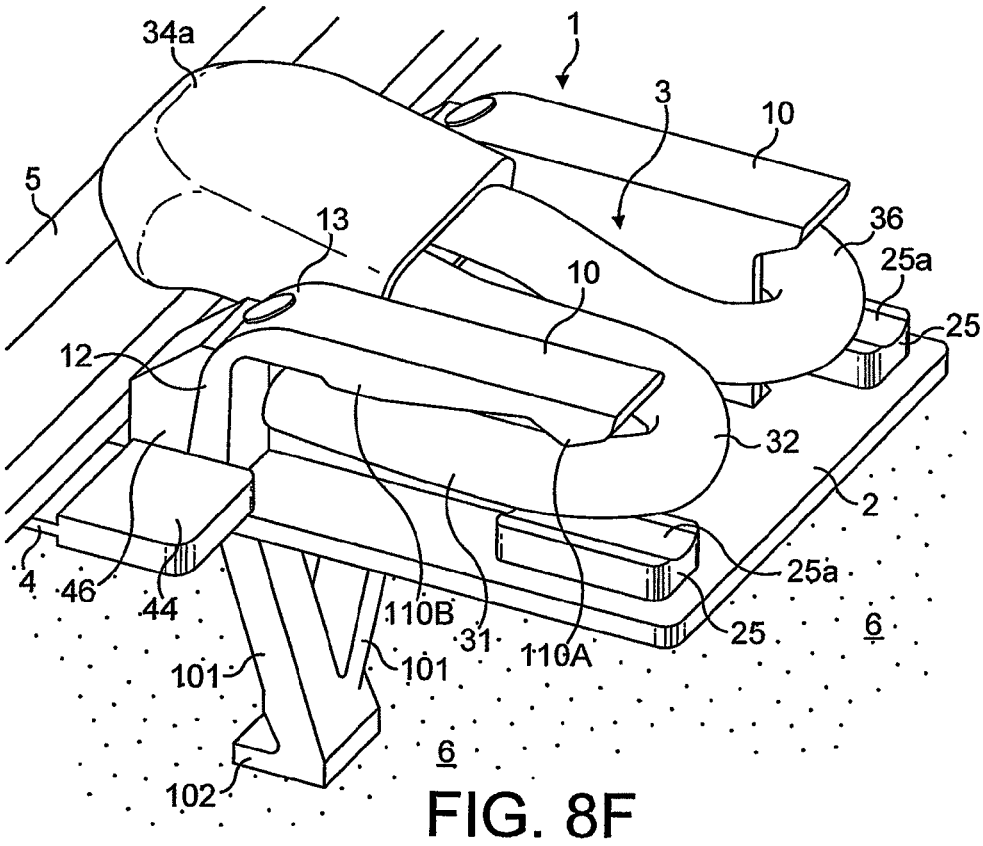

FIG. 5 shows an anchoring device embodying the first to third aspects of the present invention, FIG. 5A showing a perspective view from above, FIG. 5B showing a front view, FIG. 5C showing a part sectional view taken on the line Z-Z in FIG. 5B, FIG. 5D showing a rear view, FIG. 5E showing a side view, FIG. 5F showing a plan view from above, FIG. 5G showing a plan view from below and FIG. 5H showing a side view of another anchoring device embodying the first to third aspects of the present invention;

FIG. 6 shows a sealing plate for use with an anchoring device embodying the present invention, FIG. 6A showing a perspective view from above, FIG. 6B showing a plan view of the top surface of the sealing plate, FIG. 6C showing a plan view of the underside of the sealing plate, FIG. 6D showing a sectional view taken along the line Y-Y in FIG. 6B, FIG. 6E showing a front view of the sealing plate and FIG. 6F showing a cross-sectional view taken along the line Z-Z in FIG. 6B;

FIG. 7 shows a railway rail fastening clip for use with an anchoring device embodying the present invention, FIG. 7A showing a plan view of the clip, FIG. 7B showing a side view of the clip when in its non-operative configuration and FIG. 7C showing a side view of the clip when in an operative configuration; and FIG. 8 shows a railway rail fastening assembly employing an anchoring device embodying the present invention, in which FIGS. 8A and 8B show the assembly in a side view in which the clip is in a pre-assembly position with respect to the rail, FIG. 8B being a part cross-sectional view, FIGS. 8C and 8D show another side view of the assembly in which the clip is bearing on the rail, FIG. 8D being a part cross-sectional view, FIG. 8E shows a rear view of the assembly and FIG. 8F shows a perspective view of the assembly.

With reference to FIGS. 5A to 5G an anchoring device (shoulder) embodying the first to third aspects of the invention will now be described. The anchoring device 1 shown in FIGS. 5A to 5G comprises a head 1A from the underside of which downwardly project a stem part 1B and two spaced-part tangs 1C. The stem part 1B comprises a substantially Y-shaped stem 100, connected to the underside of the head 1A at the ends of upper arms 101 of the Y, and a bent part 102 at the other end of the Y for resisting withdrawal of the stem from the concrete in which it is embedded when it is in use. As shown in FIG. 5H, which shows another shoulder embodying the first to third aspects of the present invention, the underside of the shoulder 1 may be provided with one or more webs 1D connecting the stem 100 of the shoulder 1 to its head 1A, instead or in addition to the tangs 1C (not shown in FIG. 5H), for assisting in preventing the shoulder 1 tipping forward when a clip is driven into it.

The head 1A of the anchoring device 1 comprises two spaced-part walls 10, connected together at one end of the head 1A, at the bottom of the walls 10, by a connection portion 14. The top surface of the connection portion 14 is downwardly inclined and forms a ramp 140, while the front surface of the connection portion 14 forms the front face 12 of the shoulder 1. The end of the walls 10 at the front end of the head 1A are connected to the front face 12 of the shoulder by curved portions 13.

The walls 10 extend outwardly at their tops to provide respective clip-engaging surfaces 11 provided with two clip-engaging projections 110A, 110B, which project downwardly and are connected by means of a ramped surface 111 which inclines downwardly from the rear of the shoulder 1 to the front of the shoulder 1, for deflecting the leg of a railway rail fastening clip. The front face 12 of the shoulder 1 is provided with projections 120 for engaging with the sleeper mould so as to set the shoulder at the correct height in the mould before the concrete is introduced. The shoulder 1 has a rear face 15 opposite to the front face 12.

Unlike the prior art shoulder 1' shown in FIGS. 1A and 1B, the shoulder 1 is not provided with any parts or surfaces which would engage the downwardly-facing surface of the clip leg when installed, or partly installed, in the shoulder 1. Moreover, when the shoulder is in its operative orientation, the clip-engaging surfaces 11 cannot be seen when the shoulder is viewed from above, but can be seen when viewed from below, and all the clip contact points lie substantially at the same horizontal distance from the edge of the rail foot when measured perpendicularly to the axis of the rail and in the plane of the rail foot.

In addition, compared to the prior art shoulder shown in FIGS. 1A and 1B, the features on the top of the shoulder that were there to provide reaction points for the clip installation and extraction tools have been eliminated, new designs of tools having been developed which locate on and react off the rail rather than the shoulder. The elimination of the tool location features saves significant weight and cost from the shoulder, and also reduces the height of the shoulder and makes it less susceptible to damage. Most of the features that were used to locate the side post insulator on to the shoulder and to hold it into position have also been removed and the complexity of the shape of the shoulder has been significantly reduced, making design and manufacture of the shoulder much easier.

A plastic sealing plate 2 for use with an anchoring device embodying the present invention will now be described with reference to FIGS. 6A to 6F. The sealing plate 2 has a first major face 20 which is uppermost when the plate 2 is in use on the top of a sleeper and a second major face 21 opposite to the first. The sealing plate 2 is substantially rectangular in outline, having a cut-out portion along one side 22, defining ears 23 which ensure a seal at the corners of a shoulder 1 located above the plate 2 within the cut-out 22. The cut-out 22 has a bevelled edge 22*a* which mates with a corresponding bevelled edge on the rear face 15 of the shoulder 1. The cut-out 22 also has radiussed recesses 24 for mating with corresponding radiussed portions of the shoulder 1.

The first major face 20 of the sealing plate 2 is formed with two clip seat projections 25, which are substantially L-shaped and are located in respective corners of the first major face 20 adjacent to the side of the plate which is opposite to that having the cut-out 22. The clip seat projections 25 have respective top surfaces 25*a*, which are planar in FIGS. 6A to 6F, but may have some form of profile (see FIG. 8F) to match that of the part of the clip which is to bear on the projections 25, with a view to reducing plastic flow and wear in these areas. The plate 2 may have reinforcement in the region of the clip seat projections 25, for example the projections may be formed of a stronger material or reinforced with small steel bearing plates.

Apertures 26 are formed through the major faces 20/21 of plate 2 so as to receive portions of the shoulder 1, namely the tangs 1C, which extend through the apertures 26 in the plate 2 into the concrete of the sleeper. The major face 20 of the plate 2 is also formed with upstanding tabs 27 which are provided for cooperating with respective features on the underside of the shoulder 1 to retain the plate 2 on the shoulder 1 (and vice versa) before the plate 2 and shoulder 1 have been set into the concrete of the sleeper. If the plate is to be used with a shoulder 1 as shown in FIG. 5H, in which webs 1D are provided on the underside of the shoulder 1 between the stem 100 and the head 1A, the radiussed recesses 24 on the plate 2 would have to be deeper. If the tangs 1C on the underside of the shoulder 1 were omitted, the apertures 26 in the plate 2 could be made smaller, but would still be present to allow formation of the underside of tabs 27 during moulding of the sealing plate 2.

The shoulder 1 is held in place and positioned in the mould by means of a mechanism which pulls on the head 1A that protrudes through the bottom of the mould. The projections 120 on the shoulder 1 serve to reduce the amount of this pulling force which is applied to the sealing plate, which might otherwise distort. The walls of the projections 25 serve to prevent sideways movement of the sealing plate and shoulder during sleeper manufacture by acting against the edges of the aperture in the mould pocket.

The second major face 21 of the plate 2, which forms the underside of the plate, is formed with a plurality of intersecting ribs 28 which define numerous rebates 29. When the plate is set into the top surface of a concrete sleeper, these rebates 29, and the underside of the projections 25 which are also hollow, are filled with concrete, providing additional strength to the plate 2, and thereby reducing the amount of material, and hence cost, required to make the plate 2.

A railway rail fastening clip 3 for use with an anchoring device embodying the present invention will now be described with reference to FIGS. 7A to 7C. This clip is the subject of the applicant's co-pending PCT application. The rail clip 3 is formed from a steel rod bent so as to have, proceeding from one end A of the rod to the other end B of the rod, firstly a straight first portion 31 forming one leg of the clip, then a bent second portion 32 which bends through more than 180°, then a third portion 33, then a fourth portion 34 which forms the toe portion of the clip and is bent through 180°, then a fifth portion 35 which mirrors the shape of the third portion 33, then a sixth portion 36 which mirrors the shape of the second portion 32 and finally a seventh portion 37 which forms the other leg of the clip. Thus, when viewed as seen in FIG. 7A, the clip may be considered to be substantially M-shaped. The free ends A, B, of the rod have a chamfer 37*a* on the surface of the leg which is to be uppermost when the clip 3 is bearing on a rail for assisting in inserting the clip into the shoulder. Adjacent to the ends A, B, on the uppermost surface of the clip 3, the clip 3 is formed with detents 38 for cooperating with the projections 110A, 110B formed on the walls 10 of the shoulder 1 to retain the clip 3. The detents 38 are formed so as to have two oppositely-inclined spaced-apart faces defining respective pre-assembly and insulator-change positions relative to the shoulder 1.

Although not shown in FIGS. 7A to 7C, but seen from FIGS. 8A to 8F, the toe portion 34 of the clip 3 when in use normally carries a toe insulator 34*a* for insulating the clip 3 from the rail. The toe insulator 34*a* also extends over parts of the third and fifth portions, 33, 35 of the clip 3. In order to reduce the likelihood that the toe insulator 34*a* may be removed unintentionally from the clip 3, those portions of the toe portion 34 and third and fifth portions 33, 35 which come into contact with the toe insulator 34*a* when it is located on the clip 3 may be left free of the coating which is generally applied to the remainder of the clip.

When the clip 3 is in its non-operative configuration, i.e. a non-stressed configuration in which the clip is not in use, the longitudinal axes of all parts of the clip lie substantially in the same plane P, that is the clip is flat.

As shown in FIG. 7C, when the clip 3 is deflected into an operative configuration, by driving the clip into a shoulder 1, the legs 31, 37 of the clip 3 are driven downwards out of the first plane P into a second plane Q and the third, fourth and fifth portions 33, 34, 35 of the clip 3 are deflected upwardly out of the plane P into a third plane R, the planes P, Q, R being non-parallel.

A railway rail fastening assembly employing the elements described above will now be described with reference to FIGS. 8A to 8F. The railway rail fastening assembly of FIGS. 8A to 8F, for fastening a railway rail 5, comprises a shoulder 1 embodying the first to third aspects of the present invention, a rail fastening clip 3, a sealing plate 2 and a rail pad 4. It will be appreciated that, although not shown in FIGS. 8A to 8F, when in use the rail is fastened on both sides of the rail head by such an assembly and that the stem 1B and tangs 1C are embedded in the concrete sleeper 6. The sealing plate 2 is also embedded in the concrete sleeper 6, such that the top face of sealing plate 2 is flush with the upper surface of the sleeper 6. As shown in FIGS. 8A/8B the clip 3 may be driven into the shoulder 1 by introducing the chamfered free ends A, B of the clip legs 31, 37 into the gaps between the top surfaces 25*a* of the clip seat projections 25 on the sealing plate 2 and the first projection 110A on the outer surface of the walls 10 of the shoulder 1, and inserting the toe portion 34 of the clip 3, bearing a toe insulator 34*a*, into the space between the inner surfaces of the walls 10 of the shoulder 1, such that the toe 34 of the clip 3, through the toe insulator 34*a*, bears on the ramp 140 of the shoulder 1 and the projections 110A are located within the detents 38 in the clip legs 31, 37, with the projection 110A contacting the rear face of the detent 38. This position is known as the "pre-assembly" or "parked" position, in which the clip does not bear on the rail 5, but overlies the shelf 47 of the side post insulator portion 46 of pad 4. Downwardly-facing parts of the legs 31, 37 rest on the top surfaces 25*a* of the clip seat projections 25.

As shown in FIGS. 8C and 8D, the clip 3 can be driven from the pre-assembly position (first operative position) into a second operative position in which the toe portion 34 of the clip 3 bears on the foot of the rail 5, the second projections 110B on the walls 10 engage the detents 38 of legs 31, 37 of the clip 3 and the second and sixth portions 32, 36 (heel portions) of the clip 3 bear on the top surfaces 25*a* of the clip seat projections 25. The clip overlies the shelf 47 of the side post insulator portion 46 of the rail pad 4. The clip can be withdrawn from this position back into the pre-assembly position, if required in order to remove or work on the rail, or further back into the "insulator-change" position in which the front face of the detent 38 contacts the projection 110A and the clip 3 does not overlie the shelf 47 of the sidepost insulator portion 46 of pad 4.

As the clip 3 is installed, the toe 34 of the clip 3 is driven upwards by the ramp 140 in the centre of the shoulder 1, and the legs 31, 37 are driven down, thereby splitting the clip open. This makes it possible to make the assembly a little lower than would otherwise be possible.

The invention claimed is:

1. An anchoring device for use in retaining a railway rail fastening clip, the device comprising two interconnected spaced-apart walls, between which a portion of the clip to be retained is held when the anchoring device is in use, and clip-engaging means supported by the said walls, said clip engaging means defining contact regions which project downwardly, said contact regions engage a leg of the clip to be retained when the clip bears on a railway rail, the device only engaging the clip leg at the contact regions when the clip is bearing on the rail in normal operation, said device comprising a cast piece, said cast piece without a floor adapted for supporting said clip, characterised in that none of the said contact regions of the device can be seen when the anchoring device is viewed from above when in its operative orientation in which it will be used when adjacent to a railway rail and in that all of the said contact regions of the device can be seen when the anchoring device is viewed from below when in the said operative orientation.

2. An anchoring device as claimed in claim 1, wherein, when the device is in use, all the said contact regions of the device lie substantially at the same horizontal distance from the edge of the rail foot when measured perpendicularly to the axis of the rail and in the plane of the rail foot.

3. An anchoring device as claimed in claim 1, wherein the device does not have any feature or surface which engages the surface of that clip portion which faces downwardly when the clip is in use.

4. An anchoring device as claimed in claim 1, wherein the said walls are interconnected by a connection portion which has a part which extends between the said walls from the one end thereof, which will be closest to the railway rail when the device is in use, towards the other end thereof and has a top surface which extends in a downwardly-inclined direction so as to form a ramp for deflecting a portion of the said railway rail fastening clip to be retained as it is driven into the anchoring device.

5. An anchoring device as claimed in claim 4, wherein the said connection portion has another part which extends between the said one end of the walls below the said top surface to form a bearing face.

6. An anchoring device as claimed in claim 5, wherein the height of the said bearing face is less than that of the said walls.

7. An anchoring device as claimed in claim 6, wherein the height of the said connection portion at the said one end of the walls is approximately half that of the said walls.

8. An anchoring device as claimed in claim 4, wherein the said part of the connection portion forming the said ramp is connected to the said walls along its side edges.

9. An anchoring device as claimed in claim 1, wherein the device comprises a head provided with the said clip-engaging means and a stem extending downwardly beneath the head of the device, for use in connecting the device to a concrete sleeper.

10. An anchoring device as claimed in claim 9, wherein the said stem is located at a first end of the head, which first end is adjacent to a railway rail when the device is in use.

11. An anchoring device as claimed in claim 10, wherein there is at least one web extending between the said stem and the underside of the said head.

12. An anchoring device as claimed in claim 9, wherein the stem is approximately Y-shaped such that the portions of the stem which form the upper ends of the Y are connected to the head of the device.

13. An anchoring device as claimed in claim 9, further comprising at least one tang which extends downwardly from the underside of the head of the device.

14. An anchoring device as claimed in claim 13, when read as appended to claim 14, wherein the or each tang is located at or near a second end of the head, opposite to the first.

15. A railway rail fastening assembly comprising a resilient railway rail fastening clip and an anchoring device as claimed in claim 1, wherein the clip is such that it can be deflected from a non-operative configuration to at least one operative configuration in which a toe portion of the clip bears on a railway rail, the clip being made from a rod of resilient material shaped so as to have, proceeding from one end A of the rod to the other end B of the rod, firstly a substantially straight first portion, then a substantially bent second portion, then a third portion, then a fourth portion which is substantially U-shaped and forms the toe portion of the clip, then a fifth portion, then a substantially bent sixth portion, and finally a substantially straight seventh portion, the first and seventh portions of the clip forming leg portions, the longitudinal axes of which lie substantially in a first plane when the clip is in its non-operative configuration and, when the clip is viewed in a direction perpendicular to the said first plane, the third and fifth portions appear to lie between the first and seventh portions wherein, when the clip is in its non-operative configuration, the longitudinal axes of the second, third, fourth, fifth and sixth portions also lie substantially in the said first plane, and, when the clip is in the said at least one operative configuration, the longitudinal axes of the third, fourth and fifth portions lie substantially in a second plane and the longitudinal axes of the first and seventh portions lie substantially in a third plane, the second and third planes being non-parallel to one another, and wherein the clip is provided with clip retaining means for inhibiting unintentional withdrawal of the clip from the rail and the anchoring device is provided with clip cooperating means for cooperating with the said clip retaining means on the said clip to retain the said clip within the said anchoring device.

16. An assembly as claimed in claim 15, wherein the said clip is substantially M-shaped in plan, the region joining the inner legs of the M forming the said toe portion of the clip and the outer legs of the M forming the said leg portions of the clip.

17. An assembly as claimed in claim 16, wherein the said clip retaining means are also operable to retain the clip in a pre-assembly position in which the clip does not bear on the rail.

18. An assembly as claimed in claim 16, wherein the said clip retaining means are provided on the said leg portions of the clip.

19. An assembly as claimed in claim 15, wherein the said clip retaining means are also operable to retain the clip in a pre-assembly position in which the clip does not bear on the rail.

20. An assembly as claimed in claim 15, wherein the said clip retaining means are provided on the said leg portions of the clip.

21. An anchoring device for use in retaining a railway rail fastening clip, the device comprising: two interconnected spaced-apart walls, between which a portion of the clip to be retained is held when the anchoring device is in use, and clip-engaging means supported by the said walls, said clip engaging means defining contact regions at which the device engages the rail clip to be retained when the clip bears on a railway rail, wherein the device not engaging the clip at any other region of the device when the clip is bearing on the rail in normal operation, said device comprising a monolithic piece, said monolithic piece without a floor adapted for supporting said clip, characterised in that none of the said contact regions of the device can be seen when the anchoring device is viewed from above when in its operative orientation in which it will be used when adjacent to a railway rail and in that all of the said contact regions of the device can be seen when the anchoring device is viewed from below when in the said operative orientation.

* * * * *